US009362661B2

(12) United States Patent
Hara

(10) Patent No.: US 9,362,661 B2
(45) Date of Patent: Jun. 7, 2016

(54) CONNECTOR AND CONNECTOR DEVICE

(71) Applicant: Sumitomo Wiring Systems, Ltd., Yokkaichi (JP)

(72) Inventor: Teruo Hara, Yokkaichi (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/463,769

(22) Filed: Aug. 20, 2014

(65) Prior Publication Data

US 2015/0064948 A1 Mar. 5, 2015

(30) Foreign Application Priority Data

Aug. 28, 2013 (JP) ..... 2013-176333
Nov. 25, 2013 (JP) ..... 2013-242599

(51) Int. Cl.
*H01R 4/60* (2006.01)
*H01R 13/52* (2006.01)
*H01R 12/72* (2011.01)

(52) U.S. Cl.
CPC ..... *H01R 13/5227* (2013.01); *H01R 12/724* (2013.01)

(58) Field of Classification Search
CPC ..... H01R 13/5227
USPC ..... 439/206; 361/752
See application file for complete search history.

(56) References Cited

U.S. PATENT DOCUMENTS 4,553,807 A * 11/1985 Cane ..... H01R 13/533 439/190
6,113,407 A * 9/2000 Martin ..... H01R 13/521 439/205
7,438,576 B2 * 10/2008 Sakakura ..... H01R 13/5216 439/206
7,597,573 B2 * 10/2009 Defibaugh ..... H01R 13/46 439/206

FOREIGN PATENT DOCUMENTS

JP 2013-143286 7/2013

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A connector (10) has terminal fittings (11) extending from a housing (12) and connected to a board (50). A casing (51) is mounted on the side of an upper surface (12U) of the housing (12) and covering the board (50). Liquid retaining portions (28) are formed on the upper surface (12U) of the housing (12) by connecting longitudinal grooves (29) extending in a front-back direction and horizontal grooves (31) extending in a lateral direction. Thus, the connector (10) prevents the intrusion of liquid to the board (50) along an upper surface of the housing (12).

10 Claims, 17 Drawing Sheets

CONNECTOR AND CONNECTOR DEVICE

FIELD OF THE INVENTION

The invention relates to a connector and a connector device.

DESCRIPTION OF THE RELATED ART

Connector devices with a connector to be connected to a board and a casing for covering the connector and the board are known. For example, Japanese Unexamined Patent Publication No. 2013-143286 discloses a connector with terminal fittings extending from the rear surface of a housing and connected to a board. The board is covered by a casing to prevent contact with external matter. The connector is fixed to an edge of the board and the casing covers the entire upper surface side of the board and a part of the upper surface of the housing on the side of the board.

The above-described connector and connector device generally are covered with a drip-proof sheet to prevent the intrusion of liquid, such as water, through a clearance between a casing and a housing. However, to further enhance waterproofness, there has been a demand to prevent any liquid that may enter this clearance from further intruding to a board side along the upper surface of the housing.

The invention was completed in view of the above situation and aims to provide a connector and a connector device that prevents intrusion of liquid to a board side.

SUMMARY OF THE INVENTION

The invention relates to a connector with terminal fittings extending from a housing and configured to be connected to a board. The connector also has a casing mounted on an upper side of the housing and configured for at least partly covering the board. At least one liquid retaining portion is provided on a liquid collecting surface of the housing and has a labyrinth or meandering shape.

According to this configuration, a total groove length of the liquid retaining portion is long due to its labyrinth or meandering shape. Thus, more liquid can be retained and liquid is less likely to intrude to a board side along the liquid collecting surface of the housing.

The at least one liquid retaining portion may be formed by connecting at least one first groove extending in a first direction and at least one second groove extending in a second direction at an angle to the first direction and preferably a substantially right angle.

The liquid collecting surface may be an upper surface of the housing.

The liquid retaining portion may reach a side surface of the housing. Thus, liquid retained in the liquid retaining portion reaches the side surface of the housing and can be discharged to outside of the housing. Thus, the intrusion of the liquid to the board side along the liquid collection surface of the housing can The housing may include a connector fitting portion that can fit to a mating connector and at least one lever accommodating portion for accommodating a lever for assisting a connecting operation with the mating connector.

The connector fitting portion and the lever accommodating portion may be partitioned by a partition wall.

An opening may be formed on the liquid collection surface of the housing and may communicate with the lever accommodating portion. The liquid retaining portion preferably reaches the opening. According to such a configuration, the liquid retained in the liquid retaining portion reaches the opening and is discharged to the lever accommodating portion without intruding into the connector fitting portion. Thus, the intrusion of the liquid to the board side along the of the housing can be more reliably prevented. The invention also relates to a connector device, comprising the above-described connector and a casing configured to at least partly cover the board and to be mounted on the liquid collection surface side of the housing.

An edge of a main plate of the casing projects farther forward than a front end edge of the liquid collection surface of the housing in a connecting direction to a mating connector. At least one liquid blocking protrusion is provided on or near the edge of the main plate and projects to at least partly close a front side of a clearance between the main plate and the liquid collection surface of the housing.

According to this configuration, the entire upper surface of the housing is covered by the main plate of the casing. Thus, water is unlikely to adhere to the upper surface of the housing and intrusion of liquid into the clearance between the housing and the casing is made difficult by the water blocking protrusion on the edge of the main plate. Thus, the intrusion of liquid to the board side along the upper surface of the housing can be prevented more reliably.

The connector device may further include the mating connector connectable to the connector, and the mating connector may include an accommodation recess in which the liquid blocking protrusion is accommodated in a properly connected with the connector.

These and other features and advantages of the invention will become more apparent upon reading the following detailed description of preferred embodiments and accompanying drawings. It should be understood that even though embodiments are described separately described, single features may be combined to additional embodiments.

DETAILED DESCRIPTION OF THE PREFERRED EMBODIMENTS

Figure 1:
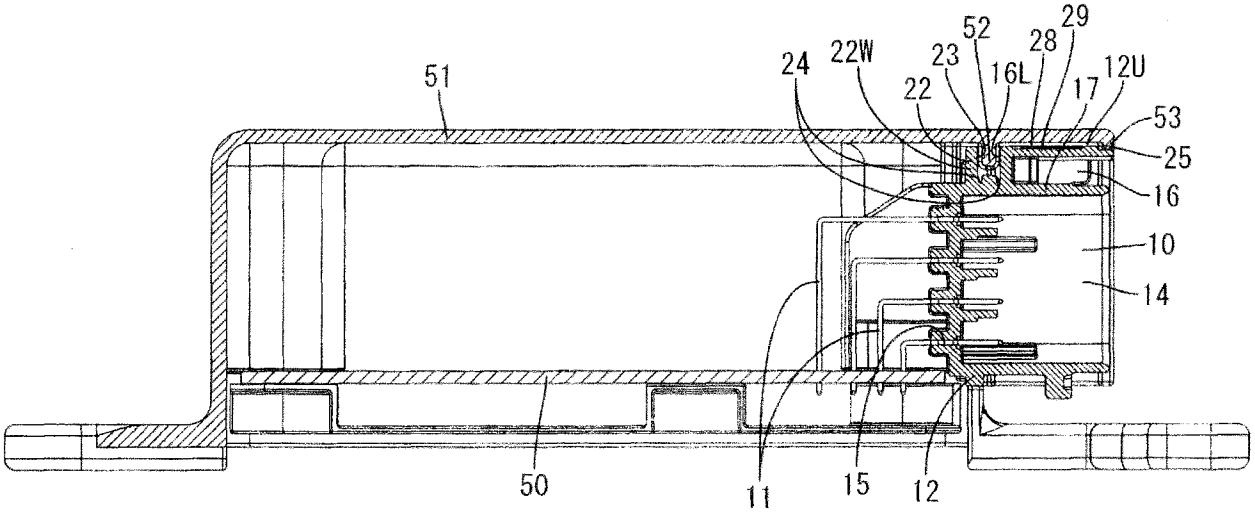
FIG. 1 is a section showing a state where a male connector according to a first embodiment is connected to a board and covered with a casing.

A first embodiment of the invention is described in detail with reference to FIGS. 1 to 13. A lever-type connector assembly in this first embodiment is an air bag connector assembly that is part of an air bag circuit. The connector assembly includes a male connector 10 and a female connector 40 that are connectable to one another. A lever 43 is provided on the female connector 40 and can be rotated to assist or perform a connecting operation. In the following description, an end of each constituent member to be connected to a mating connector is referred to as a front end, an opposite end thereof is referred to as a rear end, and upper and lower sides of FIG. 1 are respectively referred to as upper and lower sides. Further, a right side in FIG. 5 and a left side in FIG. 5 when the male connector 10 is viewed from front are respectively referred to as right and left sides. A liquid collecting surface of the housing 12 on which fluid, such as water, may collect is referred to as an upper surface 12U of the housing 12.

Figure 2:
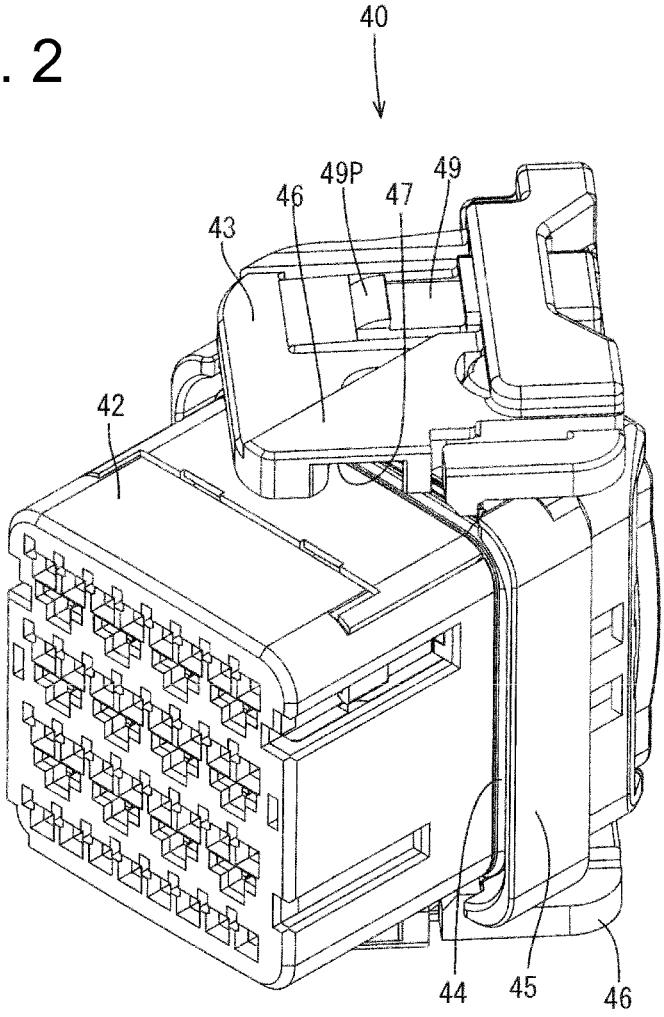
FIG. 2 is a perspective view showing a female connector.
Figure 3:
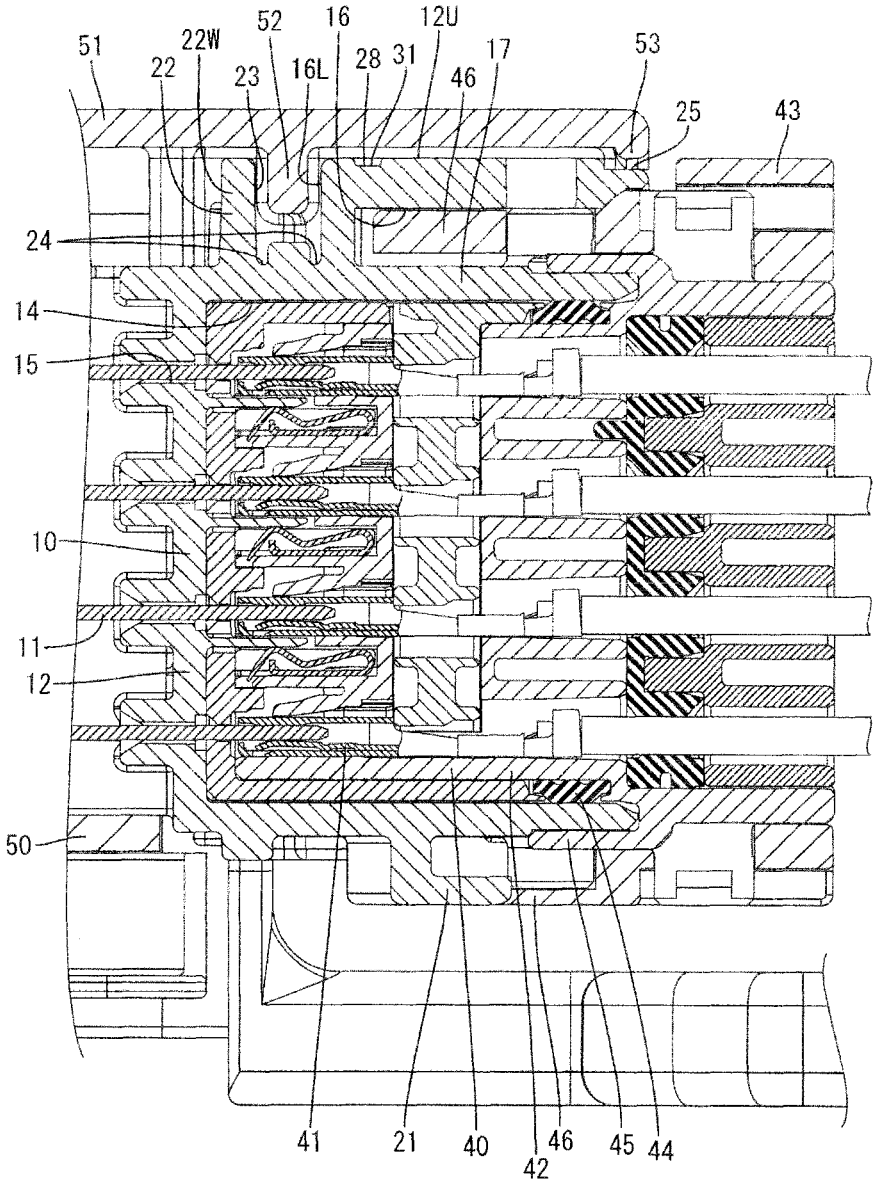
FIG. 3 is a partly enlarged section showing a properly connected state of the male and female connectors/

As shown in FIGS. 2 and 3, the female connector 40 is formed by mounting the lever 43 on a female housing 42 for holding female-type terminal fittings 41. The female housing 42 is in the form of a rectangular block made e.g. of synthetic resin, and the female terminal fittings 41 are accommodated therein.

A substantially rectangular seal ring 44 is fit on the outer periphery of the female housing 42. In a properly connected state of the male and female connectors 10 and 40, the seal ring 44 is sandwiched between the outer peripheral surface of the female housing 42 and the inner peripheral surface of a connector fitting 14 to be described later, thereby holding the interior of the connector fitting 14 in a sealed state (see FIG. 3). Note that a receptacle 45 to be fit externally on the connector fitting 14 is provided at an outer side of the seal ring 44 to cover the seal ring 44.

The lever 43 for assisting a connecting operation with the male connector 10 is mounted rotatably on the female housing 42. The lever 43 includes two cam plates 46 formed respectively with cam grooves 47 and an operating portion (not shown) couples the cam plates 46 so that the lever 43 is substantially U-shaped. The entrances of the cam grooves 47 face forward at an initial position of the lever 43. Cam pins 18 (to be described later) are introduced through the entrances of the respective cam grooves 47 when the two connectors 10, 40 are connected lightly. The lever 43 then is rotated from the initial position toward a connection position. As a result, the cam pins 18 move along the cam grooves 47 and the two connectors 10, 40 are pulled toward each other by a cam action based on the engagement of the cam pins 18 and the cam grooves 47. The cam pins 18 reach the back ends of the cam grooves 47 and the two connectors 10, 40 are properly connected when the lever 43 reaches the connection position.

The cam plate 46 is provided with a lock arm 49 that is resiliently deformable in a plate thickness direction of the cam plate 46, and a lock projection 49P is formed in a lengthwise central part of the lock arm 49. The lock projection 49P is fit into a lock hole 26 of the male connector 10 to be described later to lock the two connectors 10, 40 in a properly connected state.

The male connector 10 includes male terminal fittings 11 and a male housing 12 for holding the male terminal fittings 11. As shown in FIG. 1, the male connector 10 is a board connector and the male terminal fittings 11 extending from the male housing 12 are to be connected to a board 50. A casing 51 is mounted on the side of an upper surface 12U of the male housing 12 for at least partly covering the board 50.

The male housing 12 is made e.g. of synthetic resin and includes connector fittings 14 to which the female connectors 40 are individually connectable. Each connector fitting 14 is open forward and the female connector 40 is fit tightly therein. The connector fittings 14 are provided substantially side by side in a lateral direction, and the male housing 12 is long in the lateral direction as a whole. The connector fitting 14 in a center in the lateral direction is wider than the connector fittings 14 located laterally therefrom (see FIG. 5).

Figure 12:
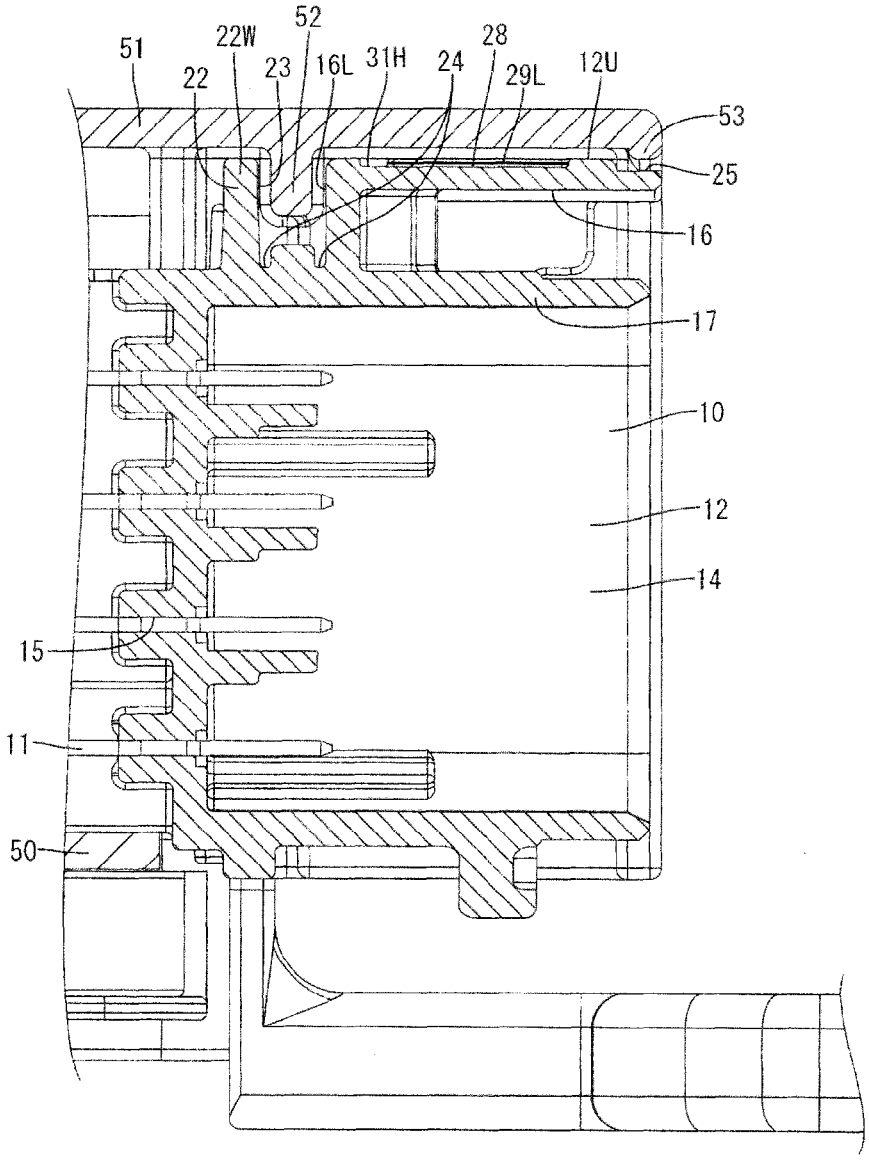
FIG. 12 is a partly enlarged section showing the liquid retaining portion and upper-surface drainage grooves of the male connector connected to the board and covered with the casing.
Figure 13:
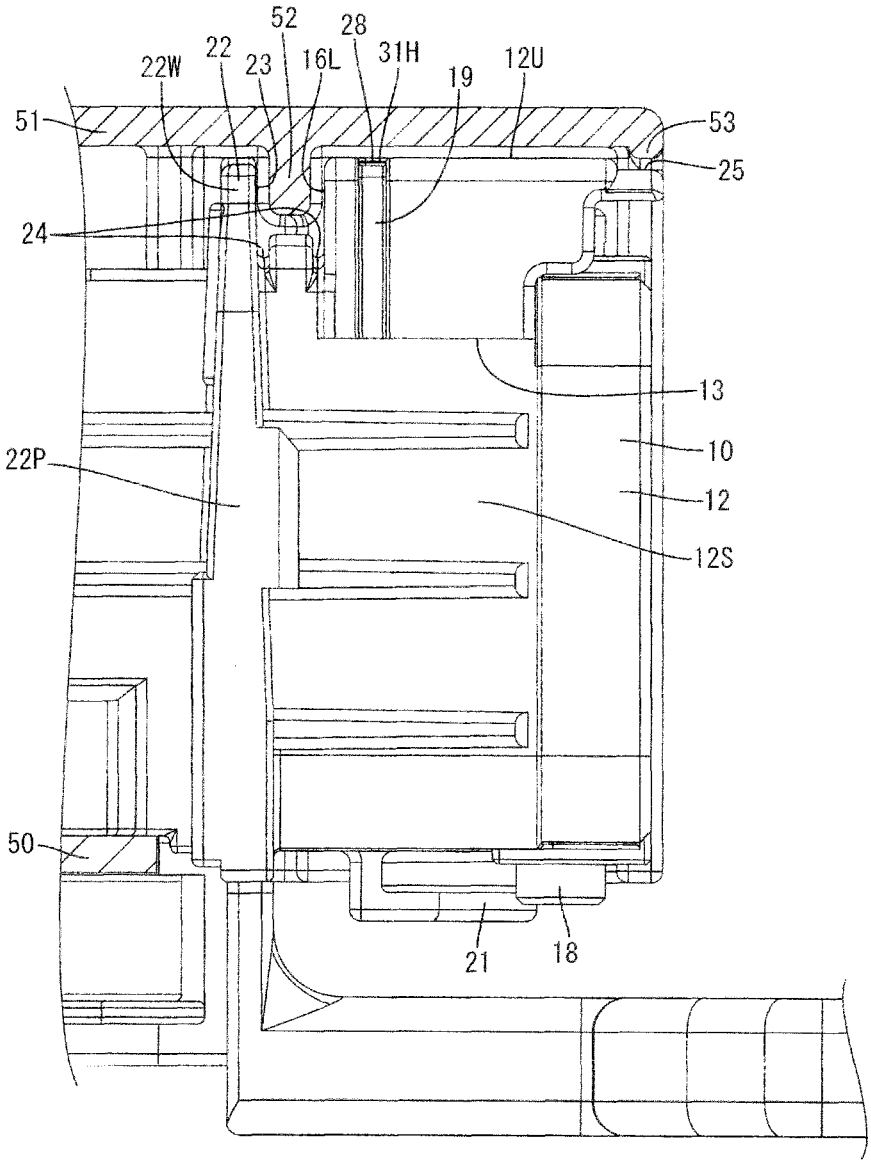
FIG. 13 is a partly enlarged section showing the upper-surface drainage grooves and a side-surface drainage groove of a male housing connected to the board and covered with the casing.
Figure 14:
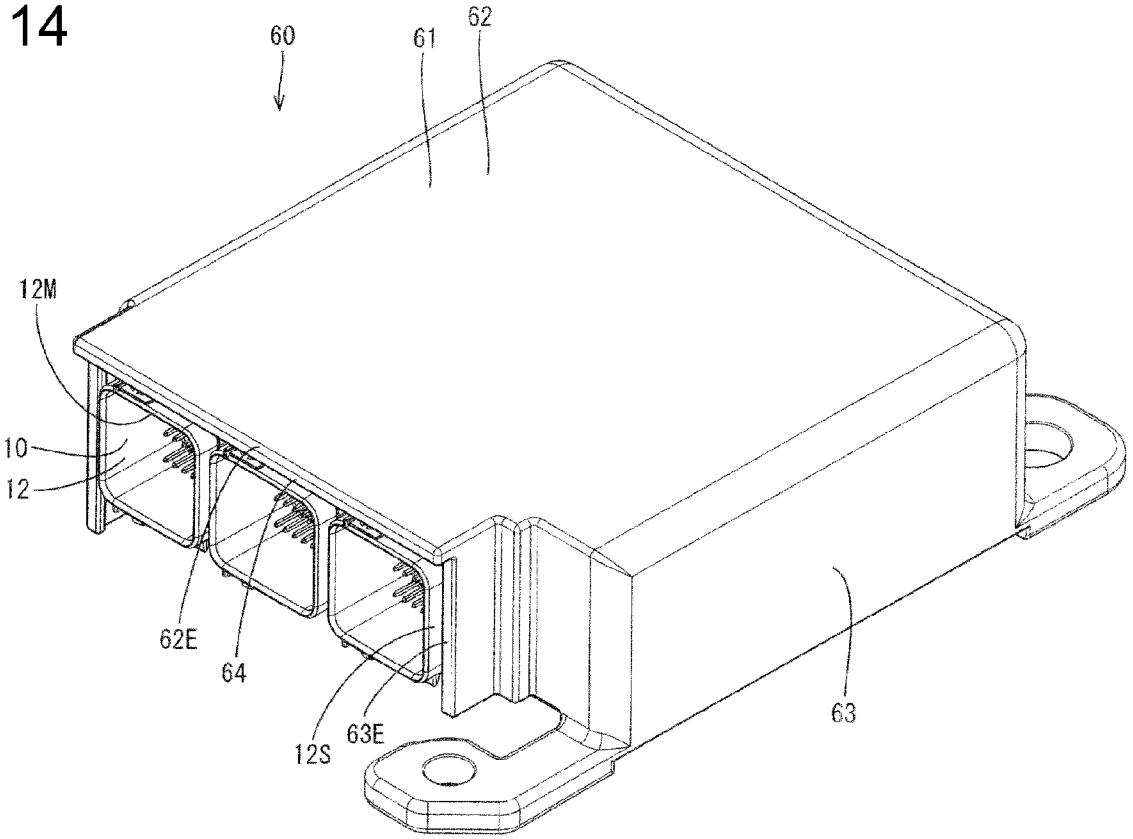
FIG. 14 is a perspective view showing a connector device according to a second embodiment before a female connector is connected.
Figure 15:
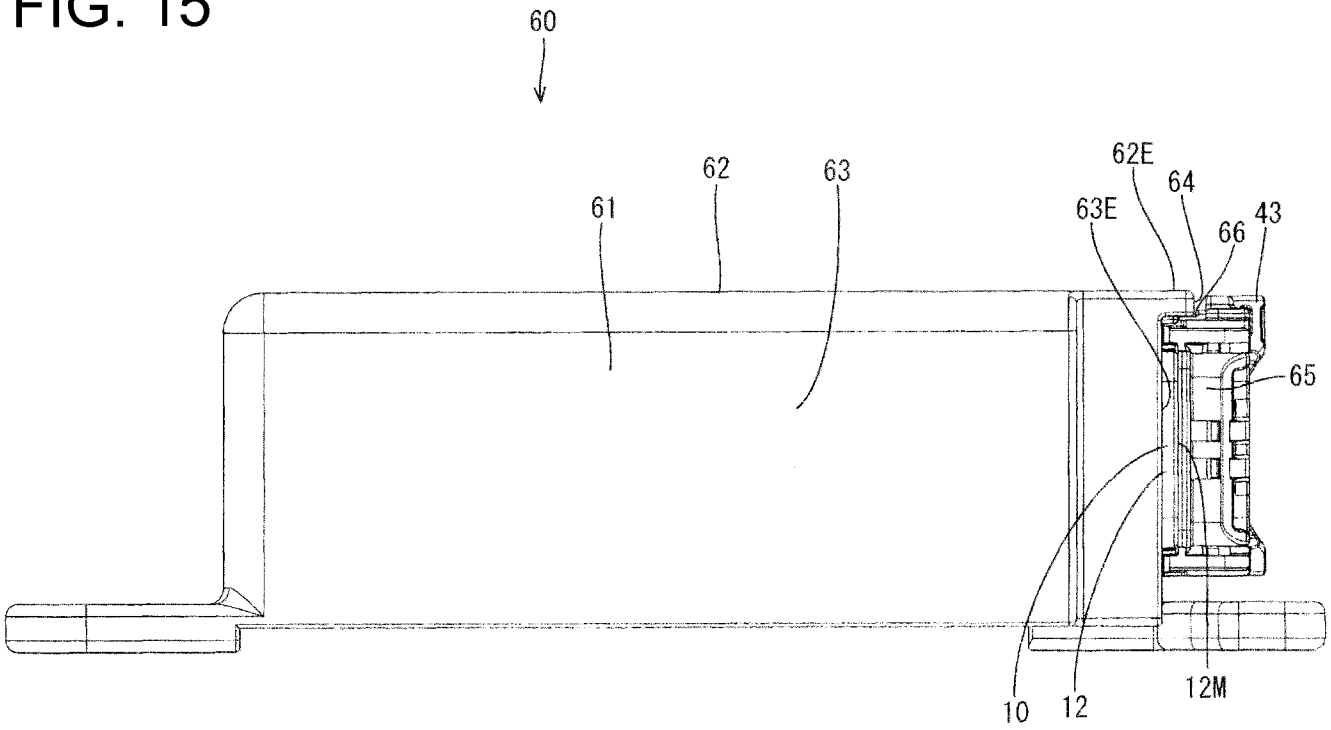
FIG. 15 is a side view showing the connector device before the female connector is connected.

The male terminal fittings 11 are formed by bending square wire materials made of conductive metal into an L shape and held by being press-fitted into terminal insertion holes 15 formed on the back wall of each connector fitting portion 14 (see FIG. 12). As shown in FIG. 1, one end of the male terminal fitting 11 press-fit into the terminal insertion hole 15 projects forward from the back wall of the connector fitting portion 14 and is electrically connectable to the corresponding female terminal fitting 41. The other end of the male terminal fitting 11 extends back from the rear surface of the male housing 12, is bent down at a right angle, inserted into an unillustrated through hole on the board 50 and connected to an unillustrated conductive path, such as by soldering.

Figure 5:
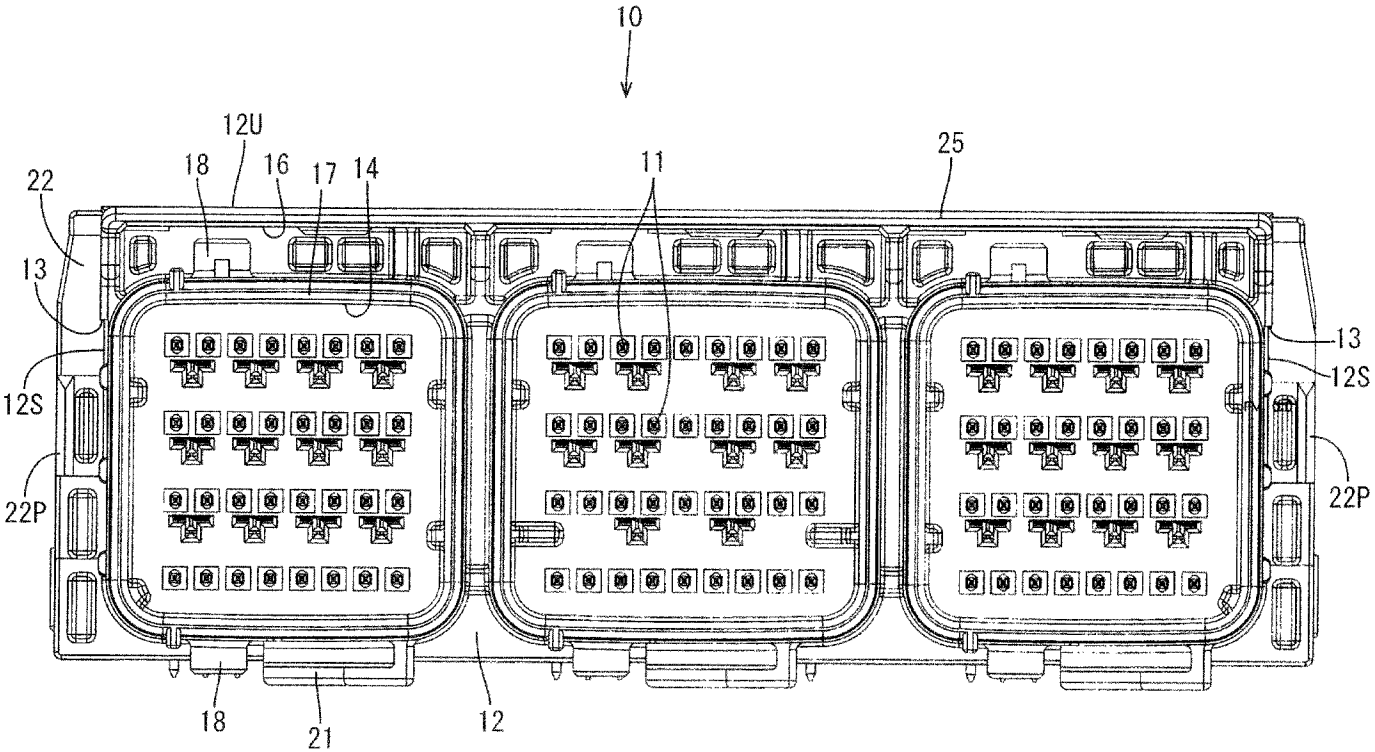
FIG. 5 is a front view showing the male connector.
Figure 9:
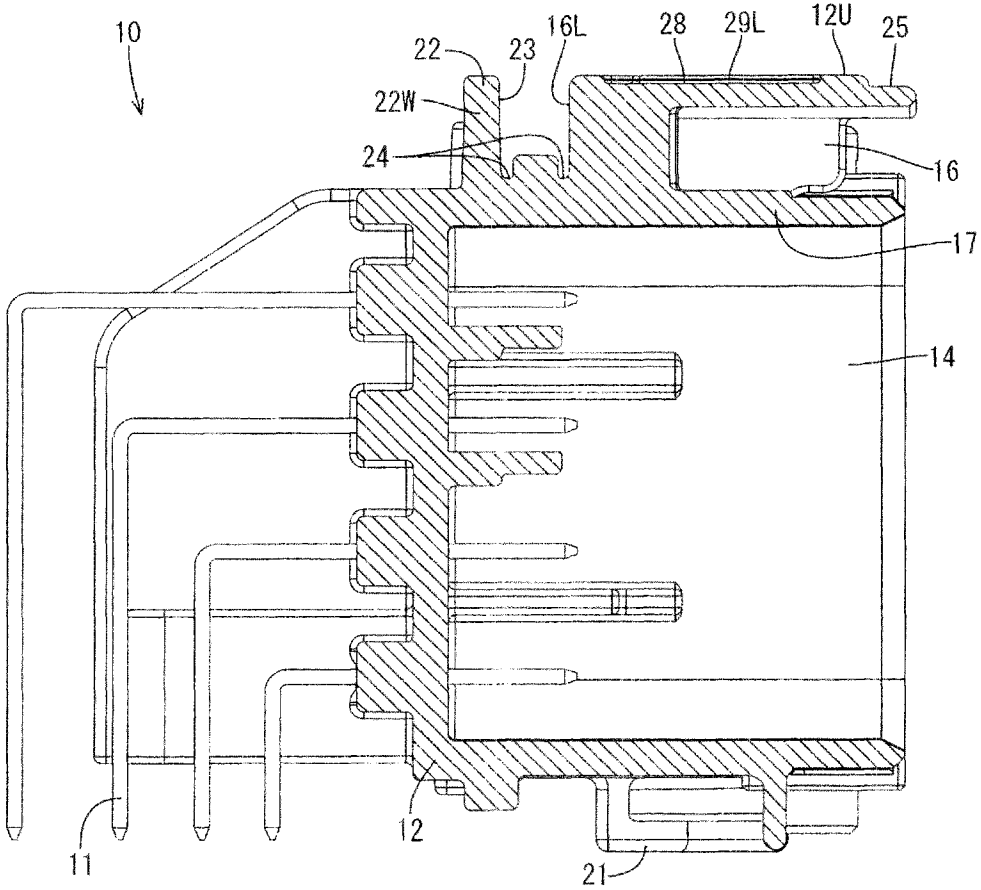
FIG. 9 is a cross-section taken along line A-A of FIG. 6.

The male housing 12 has lever accommodating portions 16 for accommodating the levers 43 when the connectors 10, 40 are connected. A lever accommodating portion 16 is provided for each connector fitting 14 and each lever accommodating portion 16 is provided above the corresponding connector fitting 14 (see FIG. 5). As shown in FIG. 9, the lever accommodating portion 16 and the connector fitting 14 are partitioned by a partition wall 17, and the lever accommodating portion 16 is open forward. As shown in FIG. 5, a side-surface step 13 is formed on a boundary between a side surface of the connector fitting 14 and a side surface of the lever accommodating portion 16 on each side 12S of the male housing 12 and the side surface of the lever accommodating portion 16 is slightly outward from that of the connector fitting 14.

Figure 7:
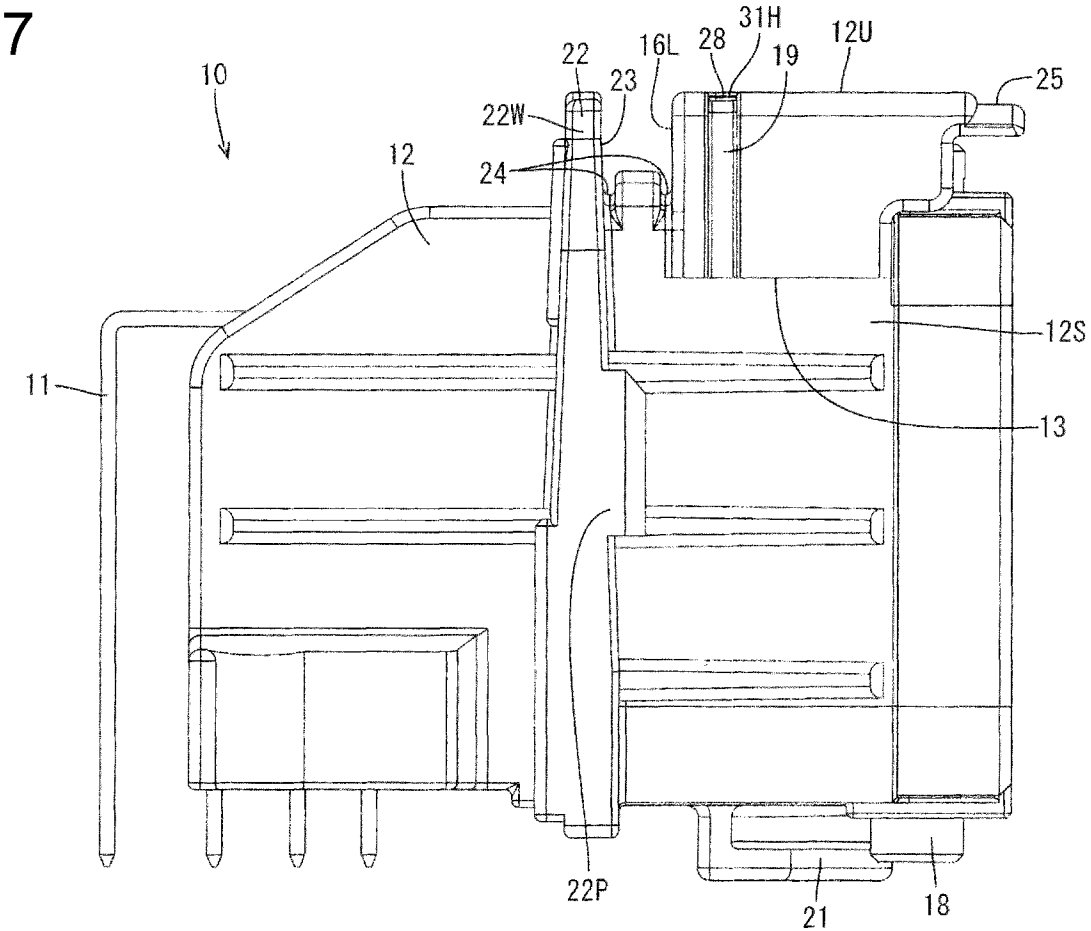
FIG. 7 is a side view showing the male connector.
Figure 8:
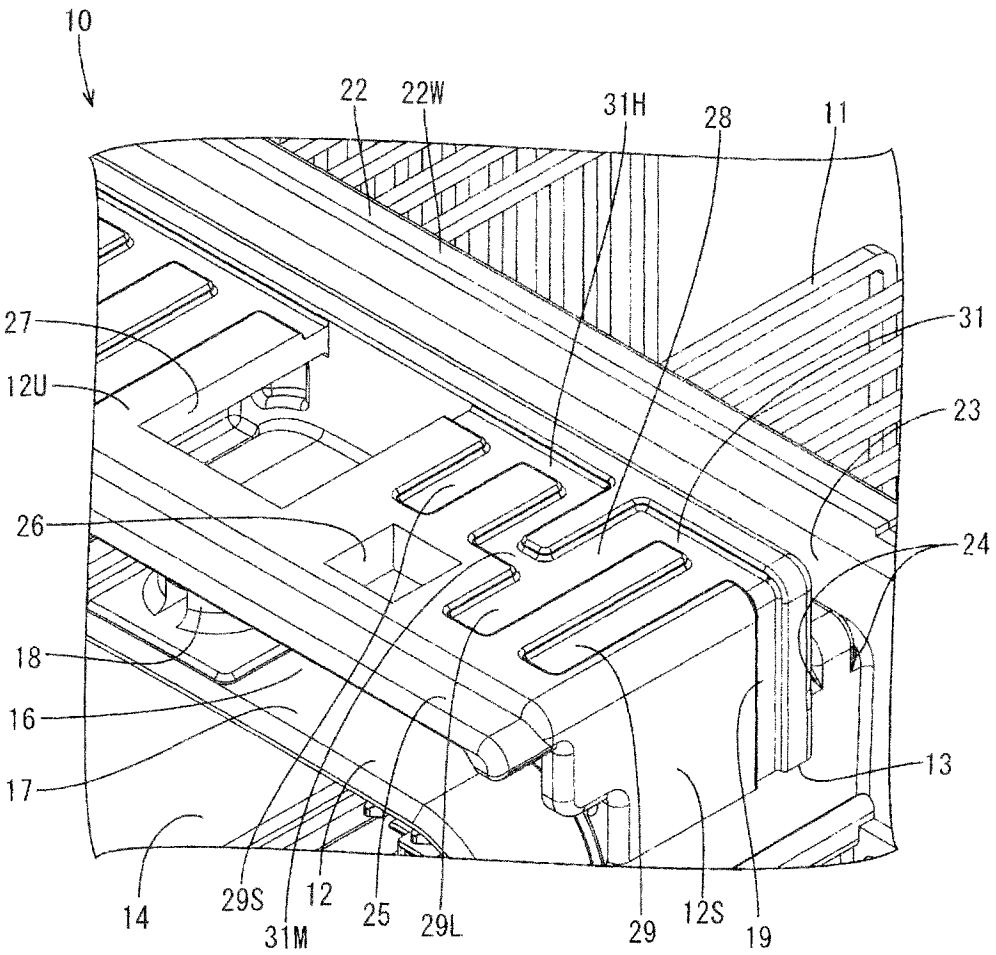
FIG. 8 is a partly enlarged perspective view showing a liquid retaining portion.

Further, as shown in FIG. 7, side-surface drainage grooves 19 are provided on the opposite side surfaces 12S of the male housing 12. Each side-surface drainage groove 19 has a width and a depth equal to the width and depth of rear horizontal grooves 31H to be described later and are continuous with the rear horizontal grooves 31H. The side-surface drainage grooves 19 extend straight downwardly from the upper surface 12U of the male housing 12 and the lower ends thereof are located at the side-surface steps 13.

The male housing 12 is provided with pairs of substantially cylindrical cam pins 18. Specifically, cam pins 18 are provided on the lower surface of each lever accommodating portion 16 and the lower surface of the male housing 12. The cam pin 18 of the lever accommodating portion 16 projects up from the lower surface of the lever accommodating portion 16, and the cam pin 18 on the lower surface of the male housing 12 projects down from the lower surface of the male housing 12 at a position substantially coaxial with the cam pin 18 of the lever accommodating portion 16 (see FIG. 5). The cam pin 18 is at a position closer to the left side than a lateral center in each lever accommodating portion 16.

Further, cam plate fitting portions 21 are provided on the lower surface of the male housing 12, and peripheral edges of the cam plates 46 of the levers 43 can fit therein. Fitting the peripheral edges of the cam plates 46 into the cam plate fitting portions 21 prevents opening deformation of the levers 43 that would cause the cam plates 46 from being separated downward from the male housing 12.

Figure 4:
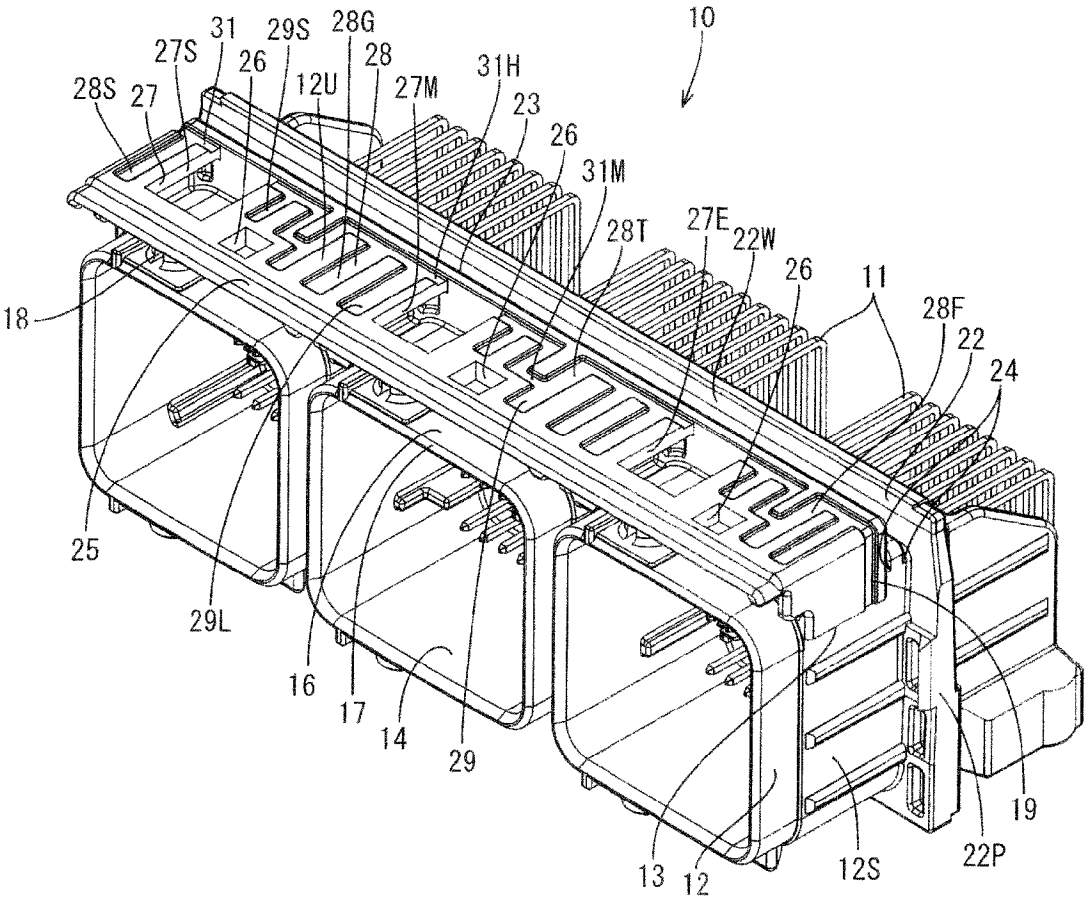
FIG. 4 is a perspective view showing the male connector.

As shown in FIG. 4, at least one rib 22 is provided at a position of the male housing 12 near the rear end. The rib 22 is provided on the opposite side surfaces 12S and the upper surface 12U of the male housing 12. Parts of the rib 22 provided on the side surfaces 12S of the male housing 12 define press-fit portions 22P to be press-fit into unillustrated grooves formed on the casing 51. Further, a part of the rib 22 provided on the upper surface 12U of the male housing 12 defines a waterproof portion 22W for preventing the intrusion of water to a rear part. The waterproof portion 22W is provided over the entire width of the male housing 12. A height of the waterproof portion 22W is equal to a height of the lever accommodating portions 16 as shown in FIG. 3.

As shown in FIG. 7, a downwardly recessed groove 23 is formed between the waterproof portion 22W and the lever accommodating portions 16. The groove 23 has a depth equal to that of the lever accommodating portions 16 and is open toward the opposite sides of the male housing 12. Note that a wall 52 provided in the casing 51 is fit into the groove 23, as shown in FIG. 12.

Figure 11:
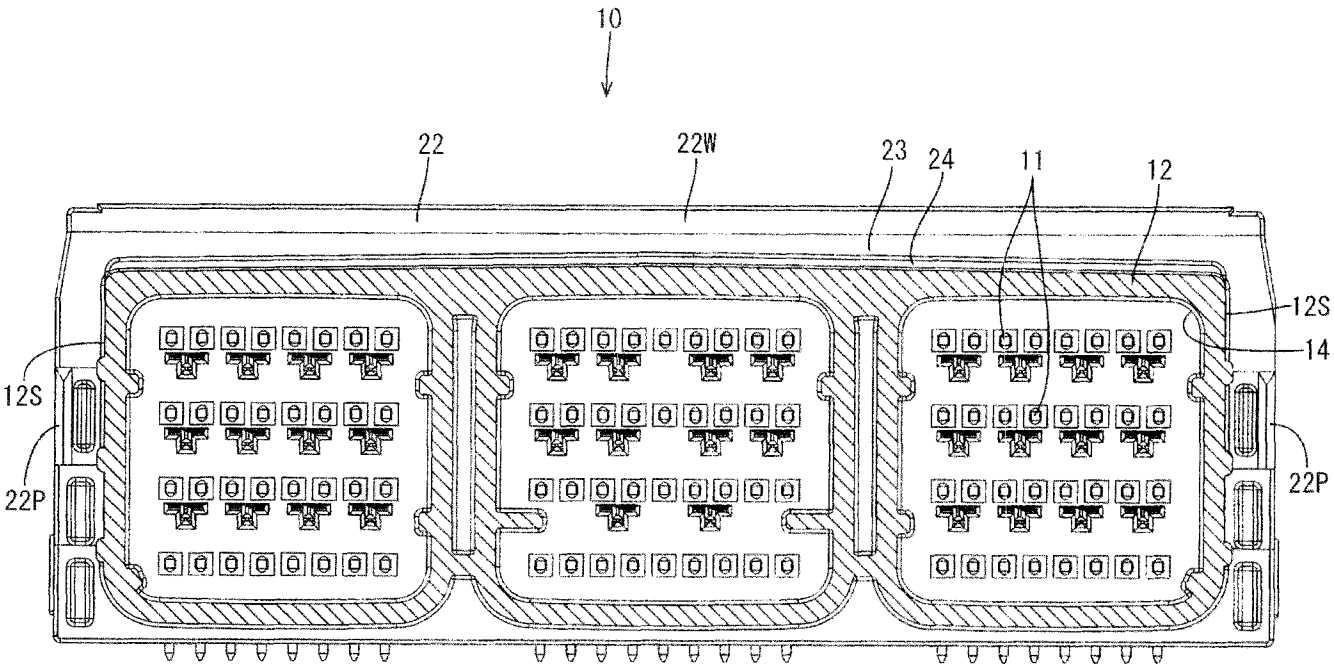
FIG. 11 is a cross-section taken along line C-C of FIG. 6.

As shown in FIG. 9, front and rear upper-surface drainage grooves 24 are formed on the bottom surface of the groove 23. The front upper-surface drainage groove 24 extends along rear wall surfaces 16L of the lever accommodating portions 16 and the rear upper-surface drainage groove 24 extends along the front surface of the waterproof portion 22W over the entire width of the male housing 12. As shown in FIG. 11, opposite ends of the upper-surface drainage grooves 24 are located at the opposite side surfaces 12S of the male housing 12, and the bottom surfaces of the upper-surface drainage grooves 24 are inclined down from the lateral center of the male housing 12 toward the opposite side surfaces 12S of the male housing 12.

A recess 25 is provided on the upper surface 12S of the male housing 12 in correspondence with a bulge 53 that bulges down along the outer peripheral edge of the casing 51 (see FIG. 3). The recess 25 is formed over the entire width of the male housing 12 along the front end edge of the upper surface 12U of the male housing 12 (see FIG. 4).

Rectangular lock holes 26 penetrate the upper surface 12S of the male housing 12 and into the lever accommodating portion 16 for each of the connector fittings 14. Each lock hole 26 is configured to receive the lock projection 49P provided on the lever 43. The lock hole 26 is provided at a position slightly closer to the right side than the lateral center of each lever accommodating portion 16.

Figure 6:
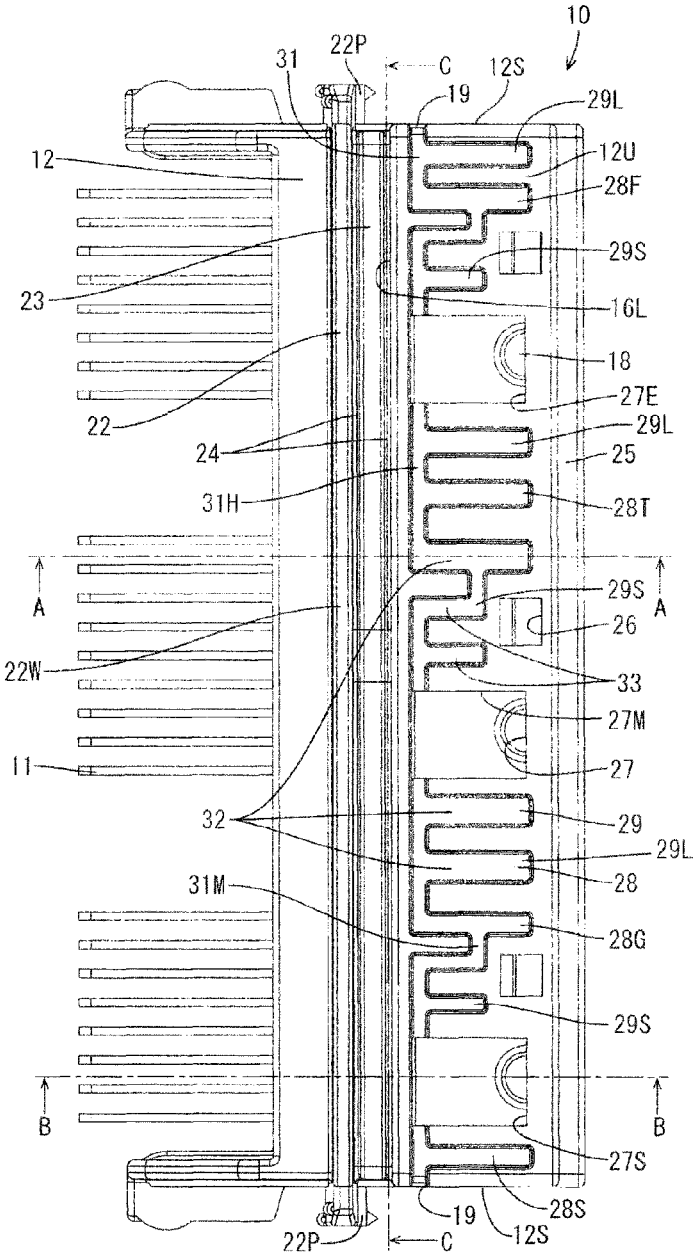
FIG. 6 is a plan view showing the male connector.
Figure 10:
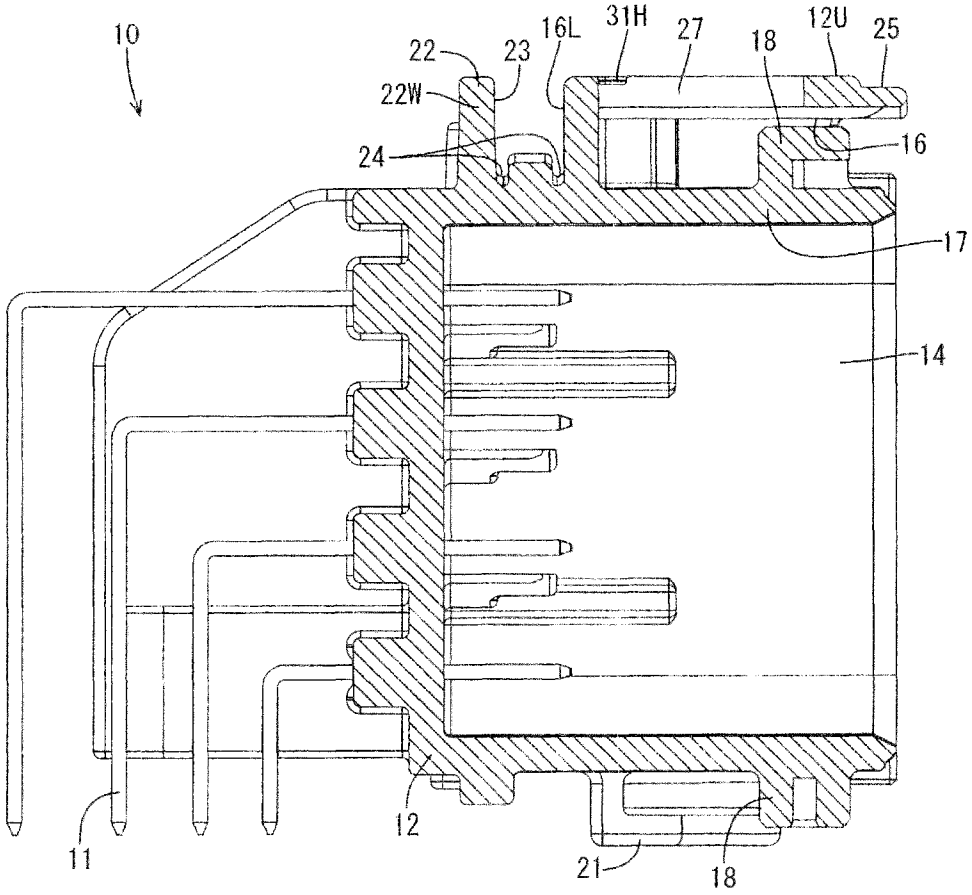
FIG. 10 is a cross-section taken along line B-B of FIG. 6.

As shown in FIG. 6, openings 27 are formed on the upper surface 12U of the male housing 12 and define mold removal holes used to form the rear surfaces of the cam pins 18. Thus, one opening 27 is provided for each lever accommodating portion 16. As shown in FIG. 10, the opening 27 penetrates from the upper surface 12U of the male housing 12 to the lever accommodating portion 16 and defines a long rectangle that extends substantially from the center of the corresponding cam pin 18 to the rear wall 16L of the lever accommodating portion 16. The opening 27 on the right end side of the housing is referred to as the right opening 27E, the opening 27 on the left end side is referred to as the left Further, as shown in FIG. 6, liquid retaining portions 28 are provided on the upper surface 12U of the male housing 12 by connecting longitudinal grooves 29 extending in the front-back direction and horizontal grooves 31 extending in the lateral direction. The liquid retaining portions 28 are arranged at opposite sides of the openings 27 formed on the upper surface 12U of the male housing 12. Each liquid retaining portion 28 is formed by connecting at least one longitudinal groove 29 and one horizontal groove 31 and each liquid retaining portion 28 reaches the side surface 12S of the male housing 12 or the opening 27. Depths of the longitudinal grooves 29 and the horizontal grooves 31 of the liquid retaining portions 28 are substantially constant.

The horizontal grooves 31 of the liquid retaining portions 28 include the rear horizontal grooves 31H located near the rear end of the male housing 12 and central horizontal grooves 31M located in a center in the front-back direction. In each liquid retaining portion 28, the rear horizontal groove 31H reaches the side surface 12S of the male housing 12 or the opening 27 and the central horizontal groove 31M connects the longitudinal grooves 29 in the lateral direction. The positions of the rear horizontal grooves 31H and the central horizontal grooves 31 of the respective liquid retaining portions 28 are aligned in the front-back direction on the upper surface 12U of the male housing 12.

As shown in FIG. 10, the rear horizontal groove 31H is located at a position displaced forward from the rear wall surface 16L of the lever accommodating portion 16 by a predetermined distance and extends substantially parallel to the rear wall surface 16L. As shown in FIG. 6, the central horizontal groove 31M connects a central part of the long longitudinal groove 29L to be described later and a front end part of the short longitudinal groove 29S and extends substantially parallel to the rear horizontal groove 31H. Note that widths of all the horizontal grooves 31 are substantially equal and constant.

The longitudinal grooves 29 of the liquid retaining portions 28 include the long longitudinal grooves 29L having a longer length and the short longitudinal grooves 29S having a shorter length, as shown in FIG. 6. The long longitudinal grooves 29L extend straight from positions spaced back from the recessed portion 25 by a predetermined distance to the rear horizontal grooves 31H. The front ends of the long longitudinal grooves 29L are located behind the front edges of the lock holes 26 and before the centers of the lock holes 26.

Two short longitudinal grooves 29S are provided behind each lock hole 26 and the length thereof is substantially half the length of the long longitudinal grooves 29L. A lateral distance between the short longitudinal grooves 29S is equal in all the liquid retaining portions 28.

The liquid retaining portions 28 adjacent to the right opening 27E is referred to herein as a first liquid retaining portion 28F and includes two long longitudinal grooves 29L and two short longitudinal grooves 29S. The two long longitudinal grooves 29L are arranged on a right side and two short longitudinal grooves 29S are arranged on a left side. The two long longitudinal grooves 29L are connected by the rear horizontal groove 31H and the two short longitudinal grooves 29S are connected by the rear horizontal groove 31H. The long and short longitudinal grooves 29L and 29S are connected by the central horizontal groove 31M. One end of the rear horizontal groove 31H connecting the two long longitudinal grooves 29L is located at the side surface 12S of the male housing 12, and one end of the rear horizontal groove 31H connecting the two short longitudinal grooves 29S is located at the right opening 27E.

The liquid retaining portion 28 at the left side of the left opening 27S is referred to herein as a second liquid retaining portion 28S and includes one long longitudinal groove 29L and one rear horizontal groove 31H. Opposite ends of the rear horizontal groove 31H are located at the other-end side opening 27S and the side surface 12S of the male housing 12.

The liquid retaining portion 28 at the right side of the middle opening 27M is referred to herein as the third liquid retaining portion 28T and the liquid retaining portion 28 at the left side of the middle opening 27M is referred to herein as a fourth liquid retaining portion 28G. The third and fourth liquid retaining portions 28T and 28G are shaped substantially identically and each has three long longitudinal grooves 29L and two short longitudinal grooves 29S. The three long longitudinal grooves 29L are arranged on a right side and two short longitudinal grooves 29S are arranged on a left side. The three long longitudinal grooves 29L are connected by the rear horizontal groove 31H and the two short longitudinal grooves 29S are connected by the rear horizontal groove 31H, and the long longitudinal groove 29L and the short longitudinal groove 29S are connected by the central horizontal groove 31M.

The rear horizontal groove 31H connecting the three long longitudinal grooves 29L of the third liquid retaining portion 28T and the rear horizontal groove 31H connecting the two short longitudinal grooves 29S is located at the middle opening 27M. In the fourth liquid retaining portion 28G, one end of the rear horizontal groove 31H connecting the three long longitudinal grooves 29L is located at the middle opening 27M, and one end of the rear horizontal groove 31H connecting the two short longitudinal grooves 29S is located at the other-end side opening 27S.

The third and fourth liquid retaining portions 28T, 28G have long and short longitudinal grooves 29L and 29S arranged at the left and right sides of the middle opening 27M that define wide and short long longitudinal grooves 32 and 33 that are slightly wider than the other long and short longitudinal grooves 29L and 29S.

Liquid could enter a clearance between the casing 51 and the male housing 12 (e.g. clearance between the bulge 53 and the recess 25) and could adhere to the upper surface 12S of the male housing 12. Such liquid could fall into the liquid retaining portions 28 and could spread in the liquid retaining portions 28 along the surfaces of the longitudinal grooves 29 and the horizontal grooves 31 of the liquid retaining portions 28. However, each liquid retaining portion 28 has a labyrinth structure in which the longitudinal grooves 29 and the horizontal grooves 31 are connected. Thus, a total length of the grooves of the liquid retaining portion 28 is long, as compared with the case where separate unconnected grooves extend in the front-back direction or lateral direction. Thus, the liquid retaining portion 28 can retain more liquid.

Liquid retained in the liquid retaining portion 28 eventually reaches the side surface 12S or the opening 27 of the male housing 12 and discharged to outside of the male housing 12. The liquid that reaches the side surface 12S of the male housing 12 is discharged along the side-surface groove 19 formed on the side surface 12S of the male housing 12, and the liquid that reaches the opening 27 is discharged to the lever accommodating portion 16. The partition wall 17 partitions the lever accommodating portion 16 and the connector fitting portion 14. Thus, the liquid discharged to the lever accommodating portion 16 is discharged to the outside of the male housing 12 without reaching the interior of the connector fitting portion 14. In this way, the liquid retained in the liquid retaining portions 28 is discharged not only from the side surfaces 12 of the male housing 12, but also from an intermediate part of the male housing 12.

Accordingly, even if liquid enters the clearance between the casing 51 and the male housing 12, that liquid is retained in the liquid retaining portions 28 and eventually efficiently discharged to the outside of the male housing 12. Thus, the intrusion of that liquid to the side of the board 50 can be reliably prevented.

According to the first embodiment, the liquid retaining portions 28 are formed by connecting the longitudinal grooves 29 extending in the front-back direction and the horizontal grooves 31 extending in the lateral direction. Thus, the liquid retaining portions 28 have a long groove length, as compared with the case where grooves extending in the front-back direction or lateral direction are separate and are not connected. Thus, more liquid can be retained. As a result, the intrusion of the liquid to the side of the board 50 along the upper surface 12U of the male housing 12 can be prevented.

The liquid retaining portions 28 reach the side surfaces 12S of the male housing 12. Thus, liquid retained in the liquid retaining portions 28 can reach the side surfaces 12S of the male housing 12 and can be discharged to the outside of the male housing 12. Thus, the intrusion of the liquid to the side of the board 50 along the upper surface 12U of the male housing 12 can be prevented.

The male housing 12 includes the connector fittings 14 that fit to the female connectors 40 and the lever accommodating portions 16 that receive levers 43 for assisting connection with the female connector 40. The connector fittings 14 and the lever accommodating portions 16 are partitioned by the partition walls 17. The openings 27 are formed on the upper surface 12U of the male housing 12 and communicate with the lever accommodating portions 16, and the liquid retaining portions 28 reach the openings 27. This causes the liquid retained in the liquid retaining portions 28 to reach the openings 27 and be discharged to the lever accommodating portions 16 without intruding into the connector fitting portions 14. Thus, intrusion of the liquid to the side of the board 50 along the upper surface 12U of the male housing 12 can be prevented.

A connector device of a second embodiment of the invention is described in detail with reference to FIGS. 14 to 17. The connector device 60 of this second embodiment differs from the first embodiment in that an edge 62E of a main plate portion 62 of a casing 61 covering an upper surface 12U of a male housing 12 projects farther forward than a front end edge 12E of the upper surface 12U of the male housing 12 in a connecting direction to a female connector 65 and a water blocking protrusion 64 projecting to close a front side of a clearance between the casing 61 and the upper surface 12U of the male housing 12 is provided on the edge part 62E of the main plate 62. Note that the same or similar components as in the first embodiment are denoted by the same reference signs and not repeatedly described.

The connector device 60 of this second embodiment includes a male connector 10 described in the first embodiment, the casing 61 configured similarly to the casing 51 described in the first embodiment and the female connector 65 configured similarly to the female connector 40 described in the first embodiment as a whole.

The casing 61 includes the main plate 62 for covering a board 50 and the upper surface 12U of the male housing 12 and a side plate 63 for surrounding the board 50 and side surfaces 12S of the male housing 12, and has a rectangular box shape as a whole.

Figure 16:
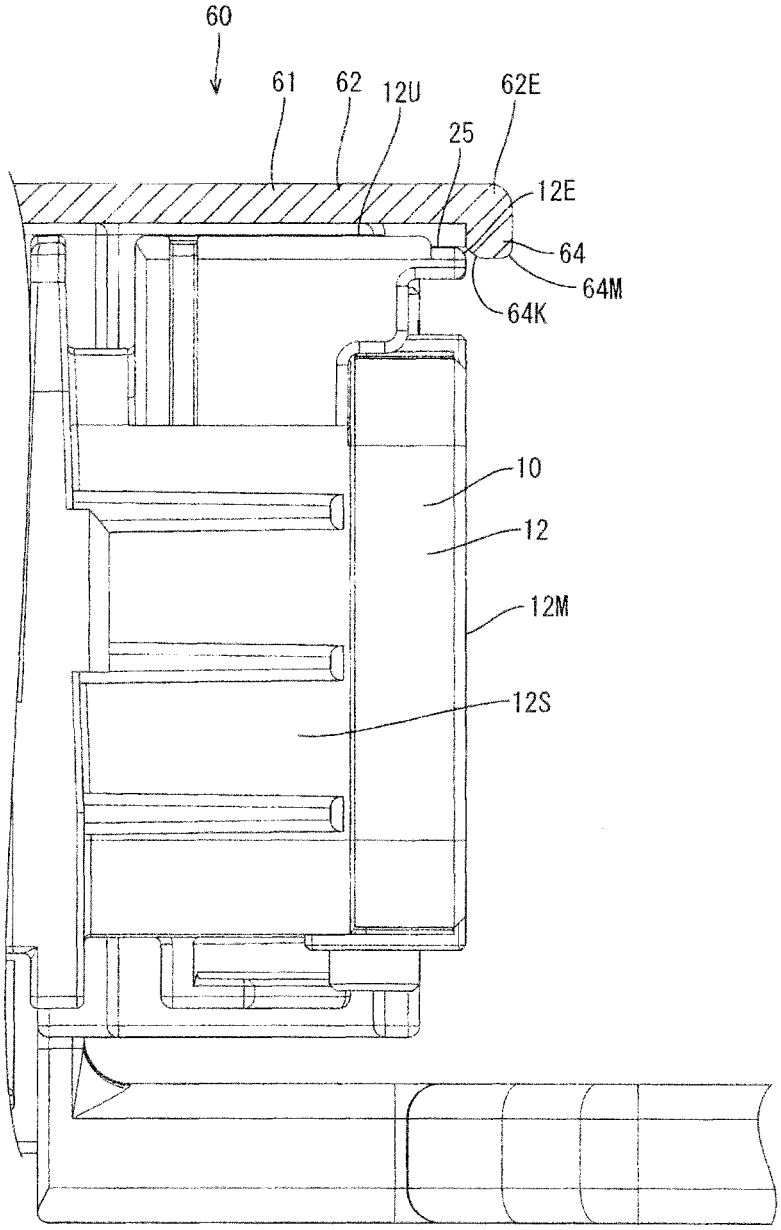
FIG. 16 is a partly enlarged section showing the connector device before the female connector is connected.

As shown in FIG. 16, the edge 62E of the main plate 62 projects farther forward than the front end edge 12E of the upper surface 12U of the male housing 12 and a front end surface 12M of the male housing 12. Further, the edge 62E of the main plate 62 projects farther forward than front end edges 63E of parts of the side plate 63 covering the side surfaces 12S of the male housing 12 (see FIG. 15).

As shown in FIG. 16, the water blocking protrusion 64 is provided on the edge 62E of the main plate 62 and projects to cover the front side of the clearance between the casing 61 and the upper surface 12U of the male housing 12. The water blocking protrusion 64 is a wall provided over the entire width of the male housing 12 and hangs down substantially perpendicularly from a plate surface of the main plate 62. The lower end of the water blocking protrusion 64 is below the clearance between the casing 61 and the upper surface 12U of the male housing 12. Note that a front of the lower end of the water blocking protrusion 64 has a rounded edge 64M, and a rear part is formed into an inclined edge 64K that inclines obliquely up toward the back.

Figure 17:
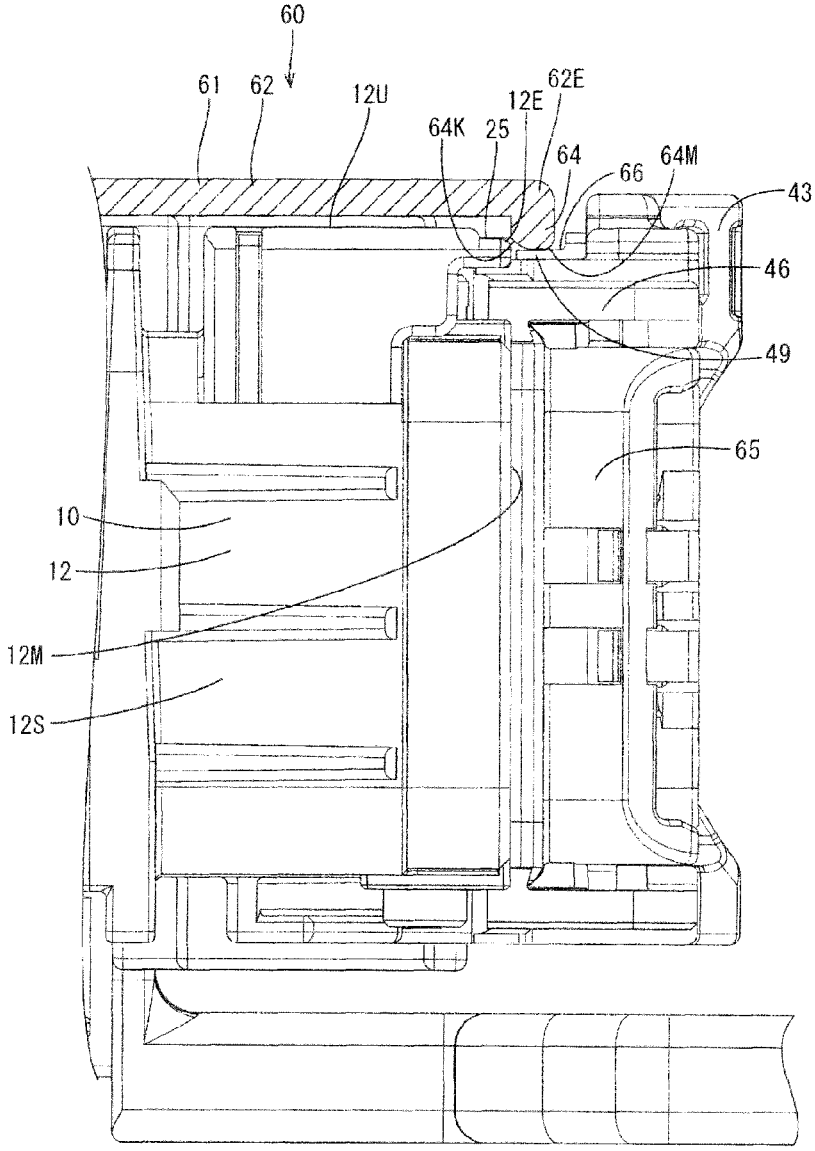
FIG. 17 is a partly enlarged section showing the connector device after the female connector is connected.

As shown in FIG. 17, the upper surface of the female connector 65 includes an accommodation recess 66 in which the water blocking protrusion 64 is accommodated when properly connected to the male connector 10. The accommodation recess 66 is provided in a part of a lock arm 49 provided on a cam plate 46 of a lever 43 behind a lock projection 49P. The accommodation recess 66 has a depth and a dimension in the front-back direction that the lower end of the water blocking protrusion 64 does not contact the female connector 65.

In the properly connected state of the connector device 60, liquid that flies toward the clearance between the upper surface 12U of the male housing 12 and the casing 61 from front of the male connector 10 will contact the front surface of the water blocking protrusion 64 and splash vertically. Further, in the connector device 60 in the properly connected state, liquid that falls down from above will fall onto the upper surface of the casing 61. Any liquid that eventually reaches the front end of the main plate 62 will fall down along the front surface of the water blocking protrusion 64. Thus, liquid will not intrude into the clearance between the upper surface 12U of the male housing 12 and the casing 61.

As described above, this second embodiment includes the male connector 10 described in the first embodiment, the casing 61 configured to cover the board 50 and to be mounted on the side of the upper surface 12U of the male housing 12 and the female connector 65 connectable to the male connector 10. The edge part 62E of the main plate 62 of the casing 61 for covering the side of the upper surface 12U of the male housing 12 projects farther forward than the front end edge 12E of the upper surface 12U of the male housing 12 in the connecting direction to the female connector 65 and the water blocking protrusion 64 projecting to at least partly close the front side of the clearance between the casing 61 and the upper surface 12U of the male housing 12 is provided on or near the edge 62E of the main plate 62. Further, the male connector 65 includes the accommodation recess 66 in which the water blocking protrusion 64 is to be accommodated in the state properly connected to the male connector 10. Since substantially the entire upper surface 12U of the male housing 12 is covered by the main plate 62 of the casing 61 in this way, liquid is unlikely to adhere to the upper surface 12U of the male housing 12 and the intrusion of liquid into the clearance between the upper surface 12U of the male housing 12 and the casing 61 is made difficult by the water blocking protrusion 64 at the edge 62E of the main plate 62. Thus, the intrusion of liquid to the side of the board 50 along the upper surface 12U of the male housing 12 can be more reliably prevented.

The invention is not limited to the above described embodiments. For example, the following embodiments also are included in the scope of the invention.

The liquid retaining portions 28 are provided on the upper surface 12U of the male housing 12 in the first embodiment. However, only one liquid retaining portion may be provided on the upper surface of the male housing.

The openings 27 are provided on the upper surface 12U of the male housing 12 and the liquid retaining portions reach the side surface 12S or the opening 27 of the male housing 12 in the first embodiment. However, the liquid retaining portions may reach only the side surfaces of the male housing without depending on whether the openings are provided on the upper surface of the male housing.

The openings 27 are provided on the upper surface 12U of the male housing 12 and the liquid retaining portions 28 reach the side surface 12S or the opening 27 of the male housing 12 in the first embodiment. However, the liquid retaining portions may reach only the openings.

Examples of the specific forms of the liquid retaining portions 28 are shown in the first embodiment. However, the forms of the liquid retaining portions 28 are not limited thereto. Any form may be adopted as long as providing a labyrinth or meandering structure in which longitudinal grooves extending in the front-back direction and horizontal or lateral grooves extending in the lateral direction are connected.

The longitudinal grooves 29 include the long longitudinal grooves 29L and the short longitudinal grooves 29S having different lengths in the first embodiment. However, they may additionally include longitudinal grooves having another different length or all the longitudinal grooves may have the same length.

The horizontal grooves 31 include the rear horizontal grooves 31H and the central horizontal grooves 31M at different positions in the front-back direction in the first embodiment. However, they may additionally include horizontal grooves at another position in the front-back direction or all horizontal grooves may be at the same position in the front-back direction.

The horizontal grooves 31 reach the openings 27 of the male housing 12 in the first embodiment, but there is no limitation to this.

The long longitudinal grooves 29L are on the right side and the short longitudinal grooves 29S are on the left side in the first, third and fourth liquid retaining portions 28F, 28T and 28G in the first embodiment. However, the long and short longitudinal grooves may be arranged differently.

The intermediate horizontal grooves 31M connect the long and short longitudinal grooves 29L and 29S in the first embodiment. However, the central horizontal groove may connect the long or short longitudinal grooves.

The accommodation recess 66 is in the part of the lock arm 49 on the lever 43 behind the lock projection 49P in the second embodiment. However, the accommodation recess 66 need not be provided or may at another position.

What is claimed is:

1. A connector with terminal fittings extending from a housing for connection to a board and a casing for at least partly covering the board is to be mounted on an upper surface side of the housing, wherein at least one liquid retaining portion having a plurality of interconnected grooves extending in a labyrinth or meander shape is provided on a liquid collecting surface of the housing the grooves in the labyrinth or meander shape defining a sufficiently large liquid retention volume on the liquid collecting surface to prevent intrusion into the housing.

2. The connector of claim 1, wherein the at least one liquid retaining portion is formed by connecting at least one groove extending in a first direction and at least one second groove extending in a second direction at an angle to the first direction.

3. The connector of claim 1, wherein the liquid collecting surface is an upper surface of the housing.

4. The connector of claim 1, wherein the liquid retaining portion reaches a side surface of the housing.

5. The connector of claim 1, wherein the housing includes a connector fitting at least partly fittable to a mating connector and at least one lever accommodating portion in which a lever for assisting a connecting operation with the mating connector is accommodated.

6. The connector of claim 5, wherein the connector fitting and the lever accommodating portion are partitioned by a partition wall.

7. The connector of claim 6, wherein an opening communicating with the lever accommodating portion is formed on the liquid collection surface of the housing; and wherein the liquid retaining portion reaches the opening.

8. A connector device, comprising:

the connector of claim 1; and a casing configured to at least partly cover the board and to be mounted on the liquid collection surface side of the housing.

9. The connector device of claim 8, wherein an edge part of a main plate of the casing projects farther forward than a front end edge of the liquid collection surface of the housing in a connecting direction to a mating connector, and at least one liquid blocking protrusion projecting to at least partly close a front side of a clearance between the main plate and the liquid collection surface of the housing is provided on or near the edge part of the main plate.

10. The connector device of claim 9, further comprising the mating connector connectable to the connector, wherein the mating connector includes an accommodation recess in which the liquid blocking protrusion is accommodated in a state properly connected to the connector.

* * * * *